United States Patent [19]

Biddle et al.

[11] Patent Number: 4,742,232

[45] Date of Patent: May 3, 1988

[54] ION GENERATOR AND ION APPLICATION SYSTEM

[75] Inventors: Alan P. Biddle, Euless, Tex.; Nobie H. Stone; David L. Reasoner, both of Huntsville, Ala.; William L. Chisholm; John M. Reynolds, both of Huntsville, Ala.

[73] Assignee: United States of America as represented by the Adminstrator, National Aeronautics and Space Administration, Washington, D.C.

[21] Appl. No.: 21,100

[22] Filed: Mar. 3, 1987

[51] Int. Cl.[4] ..... H01J 27/20

[52] U.S. Cl. ..... 250/427; 250/423 R; 250/251; 315/111.41; 315/111.71; 315/111.81

[58] Field of Search ..... 250/427, 423 R, 251; 376/127; 315/111.81, 111.41, 111.71; 313/361.1

[56] References Cited

U.S. PATENT DOCUMENTS 3,619,684 11/1971 Andrew et al. ..... 250/427

OTHER PUBLICATIONS

Abdrashitova et al., Sov. Phys. Tech. Phys., vol. 19, No. 2, Aug. 1974, pp. 264–266.

*Primary Examiner*—Craig E. Church

*Assistant Examiner*—Jack I. Berman

*Attorney, Agent, or Firm*—Joseph H. Beumer; John R. Manning; Leon D. Wofford, Jr.

[57] ABSTRACT

A vacuum chamber (12) within which an instrument (22) to be calibrated or tested is placed, is fitted with an ion gun (14) having an ion source (48). The source (48) has an electron emitting filament (60) positioned adjacent one end of an ionization chamber (71), with a negatively biased grid (72) located behind the filament (60). Gas is injected into the source (48) by a gas flow regulator (54) in one end (52) of the source (48). The chamber (71) is surrounded by a plurality of independently energizable coils (82, 84, 86, 88, 90), with the last coil (90) being operated at the highest current level, thus producing the highest magnetic flux. This presents a region (160) of magnetic repulsion to the electrons produced by the filament (60) and causes them to be confined between the grid (72) and the region (160), greatly increasing the chances that an ionization collision will occur between the electrons and atoms of injected gas. Ions are extracted from the ionization chamber (71) by a negatively biased extractor grid (106) positioned adjacent an opposite end (80) of the chamber (71) and are collimated by a negatively biased shield grid (110) positioned adjacent the extractor grid (106).

8 Claims, 2 Drawing Sheets

ION GENERATOR AND ION APPLICATION SYSTEM

ORIGIN OF THE INVENTION

The invention described herein was made by employees of the United States Government and may be manufactured and used by or for the Government for Government purposes without the payment of any royalties thereon or therefor.

TECHNICAL FIELD

This invention generally relates to systems for calibrating and testing atomic particle detection equipment, and more particularly to a system having an improved ion source which generates low energy ions in the 1–150 eV range having nearly monoenergetic values and an ion beam having low divergence angles.

BACKGROUND OF THE INVENTION

Low energy ions found in outer space may provide answers to many questions in the fields of physics and astronomy. Gathering the information these particles hold, however, sometimes requires spacecraft equipped with sensitive instruments to detect these ions and extract information about them. To achieve this, these particle detection instruments must measure various parameters about the particles which would include their energy, atomic mass, and direction of travel. In order to develop and calibrate these instruments, low energy ion sources capable of simulating ions found in outer space are required.

A low energy ion source is described in NASA Technical Memorandum 82559, dated September 1983, by A. P. Biddle, J. M. Reynolds, W. L. Chisholm, Jr., and R. D. Hunt. This ion source is constructed having an elongated housing wherein one end is closed except that this end includes an orifice through which a gas to be ionized is introduced, and the opposite end is generally open, and through it ionized particles are exhausted. An electron emitting filament is positioned near the end having the gas orifice. Next, serially, there is located an elongated, positively biased (with respect to the filament), electrically conductive cylinder constructed of a material having a high magnetic permeability. This cylinder includes grids at each end, and the cylinder and grids together are positively biased to form an anode. This anode draws electrons from the filament and accelerates them, and ionization impacts are made on the gas within this cylinder, and thus there is in effect created an ionization chamber within the anode structure. A single coil is wound around the cylinder from end to end of the cylinder, creating a magnetic flux within the ionization chamber, with the result that ionization impacts and resulting ionized particles generally respond to this dynamic movement. The ionized particles are drawn out of the ionization chamber by a negatively biased extractor grid and then passed by a small, negatively charged, hairpin-shaped filament which is employed to limit divergence of the ion beam leaving the ionization chamber.

Despite the employment of the neutralizing filament, it has been found that ion beam divergence remains substantial. In order to tolerate this divergence and to effect some collimation of the ions, fairly long drift tubes must be employed. This in turn results in a large portion of the ions being lost, which in turn results in low beam currents insufficient to determine the dynamic range and saturation points of some instruments. Further, a large proportion of the electrons emitted by the filament are lost because they are directed to the wall of the housing without undergoing an ionizing collision. This makes it necessary to operate the filament at a higher power level to overcome these losses. As a result, relatively large quantities of unionized gas are allowed to pass into an instrument test chamber employed with the ion source, this being due to incomplete ionization of the gas. Still further, the disclosed source failed to provide sufficient output below 10 eV.

It is an object of this invention to provide an improved system for testing atomic particle detection instruments employing an improved low energy ion source and which generates a beam of ions having low divergence, is more efficient in its operation, and which provides higher beam currents in the lowest ranges of operation.

SUMMARY OF THE INVENTION

In accordance with this invention, an ion source as described above would be modified in these respects. First, a grid would be added between the electron emitting filament and the adjacent end of the housing, it being negatively biased with respect to the housing. Second, instead of a single continuous coil around the cylindrical or tubular portion of the anode or the ionization chamber, a series of side-by-side, independently energizable coils are positioned around and extend the length of the chamber. Third, there is added a shield grid, positioned between the extractor grid and neutralizing filament. This shield grid aids in the prevention of the undesired divergence. The grid added between the electron emitting filament and end of the structure together with the separately energizable coils provide a tandem mirror effect which confines electrons between the grid nearest the end of the structure and a region of concentrated magnetic flux. Ions so obtained are applied to ion detection equipment for calibration and test of such equipment.

DETAILED DESCRIPTION OF THE DRAWINGS

Figure 1:
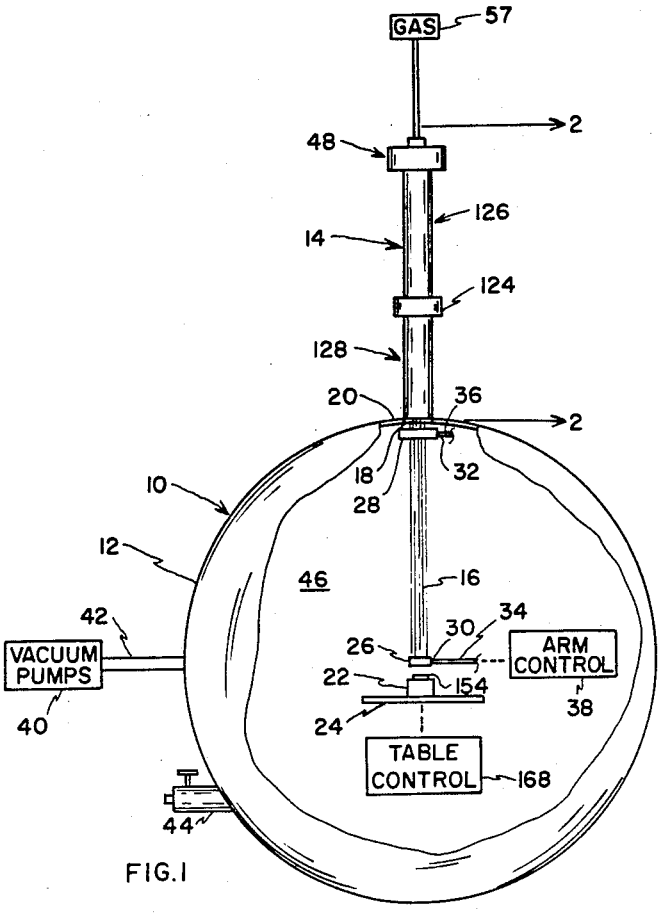
FIG. 1 is a diagrammatic view of a system for testing and calibrating particle detection equipment.

Referring initially to FIG. 1, an apparatus 10 is illustrated which is used in the design, calibration, and testing of instrumentation that measures various parameters of atomic particles, the majority of which are ions, that are found in outer space. As shown, a vacuum chamber 12 is fitted with an ion gun assembly 14 which generates a beam 16 of ions. Beam 16 is directed through an aperture 18 in wall 20 of chamber 12 onto an instrument 22, which in turn is mounted on a movable test platform 24. Retarding potential analyzers 26 and 28 and an ion mass spectrometer (not shown) are mounted to ends 30 and 32 of arms 34 and 36 which are movable by an arm control unit 38, allowing analyzers 26 and 28 and the spectrometer to be positioned in beam 16 for measurement purposes. Pumps 40 are connected to chamber 12 by a manifold 42 and maintain a vacuum of between $10^{-7}$ to $10^{-8}$ Torr within chamber 12 when apparatus 10 is in operation. An equalizing valve 44 mounted to chamber 12 allows pressure between interior 46 of chamber 12 and atmospheric pressure to be equalized. A door (not shown) mounted onto chamber 12 provides access to interior 46 of chamber 12.

Figure 3:
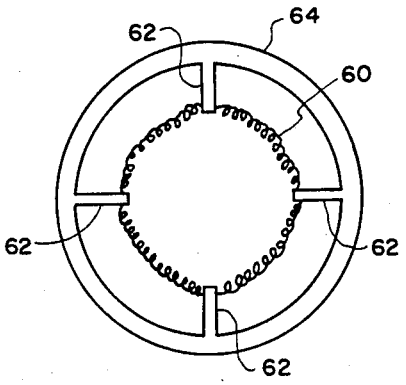
FIG. 3 is a front elevational view illustrating the arrangement of an electron emitting filament and its support.
Figure 4:
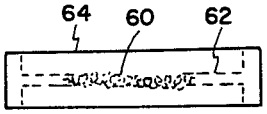
FIG. 4 is a side elevational view of the filament support, with the dotted lines showing the position of the filament.
Figure 2:
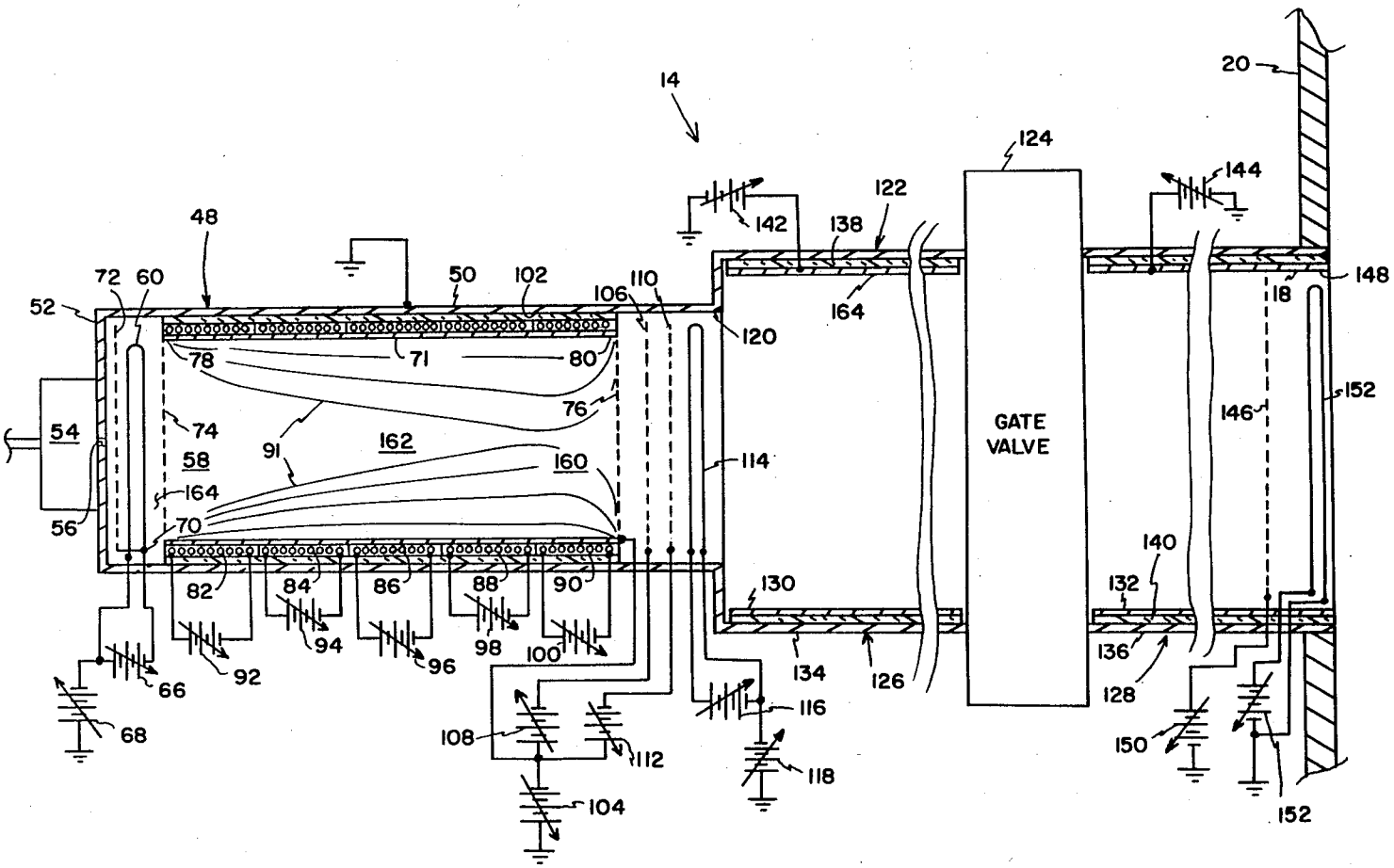
FIG. 2 is a schematic view of the ion source taken along line 2—2 of FIG. 1.

Referring now to FIG. 2, the construction of ion gun assembly 14 is illustrated. An ion source assembly 48 is constructed having a cylindrical housing 50 closed at one end 52. A gas flow regulator 54 is mounted to end 52 of housing 50 and is connected to a source of pressurized gas 57 (FIG. 1). Small quantities of working gas are injected by flow regulator 54 via inlet 56 into interior 58 of housing 50. Positioned within housing 50 near inlet 56 is a tungsten filament 60 configured as shown in FIG. 3, with filament 60 being supported by arms 52 in a ceramic support 64. Filament 60 emits electrons when heated by a variable power supply 66 and is negatively biased by a variable bias power supply 68 connected as shown to the negative heating terminal 70 of filament 60. A repeller grid 72 positioned between filament 60 and end 52 of housing 50 is connected to the most negative terminal 70 of filament 60 and serves to repel electrons emitted by filament 60.

Located near filament 60 opposite repeller grid 72 is a cylindrically configured ionization chamber 71 having anode grids 74 and 76 attached to ends 78 and 80, respectively, of chamber 71. Chamber 71 is constructed of a ferrous alloy having a high magnetic permeability and is surrounded by independently energized coils 82, 84, 86, 88, and 90, which in turn are connected to variable power supplies 92, 94, 96, 98, and 100, respectively. A layer of insulation 102 electrically insulates chamber 71 from housing 50, and a variable power supply 104 positively biases chamber 71 (e.g., +20 volts with respect to housing 50), which determines the energy of the particles making up beam 16 (FIG. 1), as will be further explained. Located near end 80 of chamber 71 is an extractor grid 106 which is negatively biased by variable bias supply 108 (e.g., −30 volts with respect to housing 50) and a shield grid 110, also negatively biased by its variable bias power supply 112. A neutralizing filament 114 having a U-shaped configuration is positioned adjacent a shield grid 110 and is heated by a variable heater power supply 116. A negative bias (e.g., −5 volts with respect to housing 50) is also applied to filament 114 by variable bias power supply 118.

Ion source assembly 48 is connected at its open end 120 to a drift tube assembly 122. Assembly 122 is generally divided by a gate valve 124 into an upper drift tube assembly 126 and a lower drift tube assembly 128. Upper and lower drift tube assemblies 126 and 128 contain smaller cylinders 130 and 132 which are electrically insulated from exterior tubes 134 and 136 by layers of insulation 138 and 140, respectively. Each of internal cylinders 130 and 132 are also constructed of high magnetic permeability ferrous alloy and are independently positively biased by variable bias power supplies 142 and 144, respectively. Cylinders 130 and 132 form an electrostatic lens which helps converge beam 16 and also shields beam 16 from structural and terrestrial magnetic fields. A grid 146 positioned near end 148 of lower drift tube assembly 128 can be positively biased by variable bias supply 150, although in normal operation grid 146 is operated at ground potential. A second neutralizing filament 152 is located in cylinder 132 near aperture 18 of vacuum chamber 12 and emits electrons when heated by variable power supply 152.

In operation, and referring to FIGS. 1 and 2, it is assumed that a test cycle has just been completed upon an instrument. Gate valve 124 is operated closed, which maintains a vacuum in upper drift tube assembly 122 and ion source assembly 48 and protects these components from contamination by dust and hydrocarbon emission particles and other atmospheric contaminants which tend to degrade the quality of beam 16. Equalizing valve 44 is then opened, allowing pressures between interior 46 of chamber 12 and ambient atmospheric pressure to equalize. After equalization is completed, the door providing access to interior 46 of chamber 12 is opened, and an instrument 22 having a particle aperture 154 is mounted on test platform 24. The door is then closed, and pumps 40 evacuate chamber 12 until a vacuum of $10^{-8}$ Torr is achieved. This is the beginning vacuum, although outgasing from equipment inside chamber 12 and instrument 22 and also from ion source gas may raise this vacuum to approximately $10^{-7}$ Torr during operation. Gate valve 124 is then opened, and ion gun assembly 14 is activated by its various power supplies.

Initially, filament 60 is heated by a heater power supply 66 and negatively biased to about −80 volts by filament bias supply 68 with respect to housing 50. This also biases repeller grid 72 which, as stated, is connected to the most negative side 70 of filament 60. As a result, electrons charged to about −80 eV (electron volts) are emitted in all directions by filament 60, with those emitted toward grid 72 being redirected toward anode grid 74 across opening 78 of ionization chamber 71. Grids 74 and 76 and ionization chamber 71 are positively biased to about +20 volts with respect to housing 50 by variable power supply 104, it being assumed for purposes of illustration that a beam energy of 20 eV is desired, although this voltage may vary from 1 to 150 volts, depending on the desired beam energy. Grid 74 allows free access of the electrons to chamber 71 while blocking the electrical field of filament 60, ensuring that the electrical field inside ionization chamber 71 remains constant. Coils 82, 84, 86, 88, and 90 surrounding chamber 72 are energized at progressively higher currents, with coil 82 operated at the least current and coil 90 operated at the most current. This forms a field of magnetic flux 91 which is more concentrated near ion exit opening 80 and presents a region 160 of magnetic repulsion to the electrons so that they simply rebound between the electrostatic mirror formed by grid 72 and the magnetic mirror in region 160 formed by coils 82–90.

Next, gas flow regulator 54 is adjusted to provide a small amount of gas flow, on the order of picoliters per minute, through gas inlet 56 to interior 58 of ion source apparatus 48. This gas may be in a pure form, such as $N_2$ (nitrogen), or a mixture of gases, depending on the desired qualities of beam 16 and the nature of the instrument under test. The gas flows into ionization chamber 71 where the individual gas atoms undergo ionizing collisions with the electrons rebounding between grid 72 and region 160, as described. As these collisions occur within a charged region 162 between grids 74 and 76, the resultant ions produced within this region assume the potential of region 162, causing 20 eV ions to be generated. Further, the energy of individual electrons undergoing collisions with gas atoms is decremented by the ionization potential of the atoms, meaning in this case electrons having an energy of about 80 eV may undergo as many as four ionizing collisions before being lost. Thus, by bouncing electrons between grid 72 and region 160, the chances of electrons making ionizing collisions is greatly increased, which greatly increases the efficiency of source apparatus 48 and decreases the power required by filament 60, which increases its lifespan. Ions produced in region 164 around filament 60 are of various potential energies due to the uneven electrical and magnetic fields around filament 60 and are repelled by the positive potential on anode grid 74. Thus, these ions are prevented from entering ionization chamber 71 and contaminating the extracted beam 16 with ions of different potential energies than ions formed as described above in ionization chamber 71.

After ions are formed in chamber 71, they are extracted by extractor grid 106, which is negatively biased at −50 volts with respect to anode grid 76, this higher negative voltage on extractor grid 106 pulling ions out of chamber 71 and accelerating them toward shield grid 110. Shield grid 110 is biased on the order of −30 volts with respect to anode grid 76. This lower negative potential on shield grid 110 tends to counter concave electrostatic potential regions which tend to naturally form because of wall and end effects around end 80 of chamber 71, which is a reason for undesired beam divergence. Shield grid 110 also establishes a planar reference surface when operated at ground potential or with a slightly negative bias and tends to axially align beam 16 with source apparatus 48. It has been shown that a slight negative bias on shield grid 110 at beam energies less than 10 eV, further reducing the tendency for divergence in beam 16. Finally, neutralizing filament 114 positioned adjacent shield grid 110 may be used to inject a small amount of negatively charged electrons into beam 16 when source apparatus 48 is operated at beam currents greater than $10^{-10}$ amperes. This keeps beam 16 from diverging from the repulsive forces of the positively charged ions. During normal operation below $10^{-10}$ amperes beam current, neutralizing filament 114 is not needed. Additionally, filament 114 is bent into a "hairpin" configuration in order to neutralize the electrical and magnetic fields produced by filament 114.

After beam 16 leaves source apparatus 48, it enters drift tube assembly 122 where beam 16 is further focused and collimated. In drift tube assembly 122, high divergence particles are lost and irregularities in beam 16 are smoothed out. Cylinders 130 and 132 form electrostatic lenses with cylinder 130 being biased at a greater positive potential than cylinder 132. Thus, as positively-charged ions pass through grounded or negatively charged shield grid 110, they are axially aligned by grid 110 and caused to converge by the increasing positive potential between grid 110 and cylinder 130. As beam 16 approaches end 164 of upper cylinder 130, it diverges slightly because of the more negative influence of gate valve 124, which is operated at a ground potential. Next, beam 16 passes into positively biased lower cylinder 132, where it is again made to converge because of the more positive potential between valve 124 and lower cylinder 132. Beam 16 then passes through cylinder 132, in a converging configuration until it encounters grid 146, which is normally operated at ground potential to establish a second planar reference surface which again collimates beam 16. Grid 146 can, however, be negatively biased to provide a converging beam when source apparatus 48 is operated at high energy levels, which is useful in determing the dynamic range of certain flight instrumentation that are insensitive to divergence angles of ions. Neutralizing filament 152 functions similar to filament 114 by injecting a small amount of electrons into beam 16 to keep it from diverging from the repulsive forces between positively charged ions and is only effective when beam currents are above $10^{-10}$ amperes.

After passing filament 152, beam 16 enters chamber 12 via aperture 18 an impinges upon one of beam measurement devices 26 and 28. Devices 26 and 28 measure various parameters of beam 16 for comparative calibration purposes, after which arm control unit 38 moves arms 34 and 36 and instruments 26 and 28 out of beam 16. Beam 16 then enters particle aperture 154 of a flight instrument 22 mounted to table 24, which may be moved in yaw, pitch, and roll axes by table control unit 168, while measurements of beam 16 by flight instrument 22 are compared with the readings taken by measurement devices 26 and 28. Flight instrument 22 may then be calibrated according to the parameters given by measurement devices 26 and 28.

From the foregoing, it is apparent that the applicants have provided a system for the testing and calibration of atomic particle detection equipment having an improved ion source for efficiently generating a monoenergetic ion beam having low divergence angles.

We claim:

1. A system comprising emission means for emitting a beam of ions said emission means comprising:

a cylindrical first housing having an axis extending longitudinally in said first housing and first and second ends, said first housing being closed at said first end and open at said second end through which ions are emitted;

gas insertion means positioned in said closed first end for injecting at least one gas into said first housing;

electron emission means positioned near said first end of said first housing for emitting electrons;

electron repulsion means, including a first grid positioned between said closed first end of said first housing and said first electron emission means for repelling said electrons away from said first end of said first housing;

first biasing means for adjustably applying a negative voltage to said electron emission means and said electron repulsion means with respect to said first housing;

a first cylinder having first and second ends and of a smaller diameter than said first housing, said first cylinder concentrically positioned within said first housing, with said first end of said first cylinder adjacent said first electron emission means;

second biasing means for adjustably applying a positive voltage to said first cylinder with respect to said first housing;

second and third grids connected across said first and second ends, respectively, of said first cylinder and in electrical contact with said first cylinder, said first cylinder and said second and third grids defining a positively biased ionization chamber therein;

a plurality of separately energizable coils around and serially positioned along said first cylinder, whereby, when said coils are energized, a region of magnetic repulsion to electrons is formed in said first cylinder adjacent said second end, and, in combination with said electron repulsion means, forms a region for confining electrons therebetween;

a fourth grid positioned in a region exterior and adjacent said second end of said first cylinder; and third biasing means for adjustably applying a negative voltage to said fourth grid, said last-named negative voltage being with respect to the positive voltage applied to said first cylinder.

2. A system as set forth in claim 1 comprising;

a fifth grid positioned in a region adjacent to and spaced from said fourth grid; and fourth biasing means for adjustably applying a negative voltage to said fifth grid, said last-named negative voltage being with respect to the positive voltage applied to said first cylinder.

3. A system as set forth in claim 2 comprising:

a first electrically heated, U-shaped filament spaced from said fifth grid and positioned adjacent said first end of said cylindrical first housing; and fifth biasing means for adjustably applying a negative voltage to said first U-shaped filament with respect to said first housing.

4. A system as set forth in claim 1 further comprising a drift tube, in turn comprising:

a tubular second housing having first and second ends, said first end of said second housing coupled to said second end of said first housing, and through which said ions enter said drift tube;

at least one electrically conductive second cylinder positioned within said second housing;

a sixth grid positioned in said second housing adjacent said second end of said second housing, and through which said ions exit said drift tube;

a gaseously sealable enclosure having an opening, and said second end of said second housing being coupled to said last-named opening;

movable support means positioned within said enclosure for supporting and moving an instrument being tested;

beam analyzing means movably supported within said enclosure for analyzing said beam of atomic particles; and pumping means for evacuating said first housing and said second housing and said enclosure and creating a vacuum therein.

5. A system as set forth in claim 4 wherein said drift tube comprises:

second and third conductive cylinders serially arranged in said tubular second housing;

fourth and fifth biasing means for adjustably applying positive voltages to said second and third cylinders, respectively, with respect to said first housing; and valve means positioned between said third and fourth cylinders, whereby a vacuum is continuously maintained in said first housing and in a portion of said drift tube adjacent said first housing.

6. A system as set forth in claim 1 wherein said electron emission means comprises a spirally-configured tungsten filament circularly formed about said axis of said cylindrical first housing.

7. A system as set forth in claim 5 wherein said second and third cylinders are constructed of a ferrous alloy.

8. A system as set forth in claim 5 comprising a second U-shaped, electrically heated filament spaced from said sixth grid and positioned adjacent said opening in said enclosure.

* * * * *